US010724529B2

(12) United States Patent
Lin

(10) Patent No.: US 10,724,529 B2
(45) Date of Patent: Jul. 28, 2020

(54) OMNIDIRECTIONAL OSCILLATING FAN WITH CLAMP

(71) Applicant: SHENZHEN LUANSHENG ELECTRONIC TECHNOLOGY CO. LTD., Shenzhen, Guangdong Province (CN)

(72) Inventor: Yong Gan Lin, Guangxi Province (CN)

(73) Assignee: SHENZHEN LUANSHENG ELECTRONIC TECHNOLOGY CO. LTD., Shenzhen, Guangdong Province (CN)

( * ) Notice: Subject to any disclaimer, the term of this patent is extended or adjusted under 35 U.S.C. 154(b) by 143 days.

(21) Appl. No.: 16/026,061

(22) Filed: Jul. 3, 2018

(65) Prior Publication Data

US 2020/0011338 A1 Jan. 9, 2020

(51) Int. Cl.

| | |
|---|---|
| ***F04D 25/10*** | (2006.01) |
| ***F04D 29/64*** | (2006.01) |
| ***F04D 25/06*** | (2006.01) |

(52) U.S. Cl.

CPC ..... *F04D 25/105* (2013.01); *F04D 25/0673* (2013.01); *F04D 29/646* (2013.01)

(58) Field of Classification Search

None

See application file for complete search history.

(56) References Cited

U.S. PATENT DOCUMENTS

2019/0003480 A1* 1/2019 Hall ..... F24F 11/58

OTHER PUBLICATIONS

Kevin Reviews Stuff (SkyGenius Oscillating Desk Fan—https://www.youtube.com/watch?v=jcWRHWhlu1Q—May 9, 2018) (Year: 2018).*

AwkwardHamster (SkyGenius Desk Clip Fan—https://www.youtube.com/watch?v=YPINClyKN1E—Jul. 28, 2016) (Year: 2016).*

* cited by examiner

*Primary Examiner* — Igor Kershteyn
*Assistant Examiner* — Juan G Flores
(74) *Attorney, Agent, or Firm* — Li & Cai Intellectual Property Office

(57) ABSTRACT

The present disclosure discloses an omnidirectional oscillating fan with a clamp, including: a base, a mounting part being disposed on a mounting surface of the base, a main fan unit, disposed on a side of a support surface of the base, and an oscillating main control assembly, disposed between the main fan unit and the base. A cross section, perpendicular to an extending direction, of the mounting part has a circular shape. The main fan unit has a columnar shape. The oscillating main control assembly includes: a first rotational assembly, partially disposed in the mounting part, and a second rotational assembly, having one end rotatably assembled to the main fan unit and the other end fixedly assembled to a rotating end of the first rotational assembly, and being capable of rotating synchronously with the first rotational assembly.

8 Claims, 4 Drawing Sheets

A

OMNIDIRECTIONAL OSCILLATING FAN WITH CLAMP

BACKGROUND OF THE INVENTION

1. Technical Field

The present disclosure relates to the technical field of electric fans, and in particular, to an omnidirectional oscillating fan with a clamp.

2. Background

A fan is a tool used to create wind for cooling in hot weather, and is an apparatus powered by electricity to generate an air flow. Fan blades in a fan are powered to rotate to produce natural wind to achieve a cooling effect.

Most existing electric fans with a clamp can rotate and swing in only a predetermined area in one direction, so as to improve the uniformity of wind blowing of the fans to improve the cooling effect of the fans.

The foregoing structure can swing in a predetermined area but has a limited rotation angle. As a result, the swing range is small, the swing effect is poor, and the application range is small. Therefore, an improvement needs to be made.

SUMMARY

For the deficiency in the prior art, the objective of the present disclosure is to provide an omnidirectional oscillating fan with a clamp that has advantages including a wide swing range, a desirable swing effect, and a wide application range.

The foregoing objective of the present disclosure is achieved by using the following technical solution:

An omnidirectional oscillating fan with a clamp includes: a base, a mounting part protruding in a vertical direction of a mounting surface of the base being disposed on the mounting surface, a main fan unit, disposed on a side of a support surface of the base, and used to supply air to a user, and an oscillating main control assembly, disposed between the main fan unit and the base, and used to implement omnidirectional rotation of the main fan unit with respect to the base. A cross section, perpendicular to an extending direction, of the mounting part has a circular shape. The main fan unit has a columnar shape. The oscillating main control assembly includes: a first rotational assembly, partially disposed in the mounting part, and used to implement rotation of the main fan unit around an axis of the mounting part, and a second rotational assembly, having one end rotatably assembled to the main fan unit and the other end fixedly assembled to a rotating end of the first rotational assembly, and being capable of rotating synchronously with the first rotational assembly. The second rotational assembly is used to implement rotation of the main fan unit around a horizontal diameter of the main fan unit.

By using the foregoing technical solution, during the use of the omnidirectional oscillating fan, first, the second rotational assembly is disposed to implement rotation of the main fan unit around the horizontal diameter of the main fan unit, to adjust outlet wind directions of the main fan unit, thereby expanding a use range of the oscillating fan; next, the first rotational assembly is disposed to implement rotation of the second rotational assembly around the axis of the mounting part, so that the first rotational assembly can swing in a vertical direction, thereby improving the swing effect of the oscillating fan; and finally, the first rotational assembly and the second rotational assembly are combined, so that the main fan unit can swing in a vertical direction and can at the same time adjust an outlet wind direction of the main fan unit according to different wind direction requirements, to satisfy requirements of customers and provide the oscillating fan with advantages including a wide swing range, a desirable swing effect, and a wide application range.

Furthermore, the second rotational assembly includes: a rotary ring rotatably assembled to the main fan unit; a bearing sleeve, disposed on a side, near the base, of the rotary ring, and used for assembly to the first rotational assembly; and a limit assembly, disposed on the rotary ring, rotatably assembled to the main fan unit, and used to implement rotation of the main fan unit with respect to the rotary ring within a predetermined angle.

By using foregoing technical solution, the main fan unit is mounted on the rotary ring, so that the main fan unit can rotate around the horizontal diameter of the main fan unit, the user may adjust an outlet wind direction according to different requirements, so as to satisfy requirements of customers, expand the application range, and improve the experience of customer. The bearing sleeve is assembled to an upper rotary support plate, so that the rotary ring can rotate around an axis of the upper rotary support plate. In this way, rotations are combined to enable the fan to blow wind in all directions in three-dimensional space, thereby ensuring the application range of the fan; and finally, the limit assembly is used to limit the rotation of the main fan unit within a predetermined angle, thereby avoiding the problem that internal circuits are twisted and broken due to an excessively large rotation angle of the main fan unit.

Furthermore, a mounting hole is provided in a position that is on the main fan unit and is for assembly to the rotary ring, and the limit assembly includes: a mounting column, disposed protrudingly in a radial direction of the rotary ring, and used for rotatable assembly to the mounting hole, where a boss is provided on a side, away from the rotary ring, of the mounting column; a first limit strip, disposed protrudingly on a side, away from the rotary ring, of an inner wall of the mounting hole; and a second limit strip, disposed protrudingly at the boss in a radial direction, and used to adapt to the first limit strip.

By using the foregoing technical solution, the first limit strip and the second limit strip are disposed in combination to implement the rotation of the main fan unit with respect to the rotary ring within a predetermined angle. The design is smart and simple.

Furthermore, the inner wall of the mounting hole is disposed to have a wavy form, and an elastic part used for abutting the inner wall of the mounting hole is disposed between the boss and the rotary ring on the mounting column.

By using the foregoing technical solution, the elastic part on the mounting column abuts the inner wall of the mounting hole, so that during rotation, the main fan unit can stop in any position after rotation, thereby resolving the problem of fixing the main fan unit after rotation, and ensuring the effect of using the main fan unit after rotation.

Furthermore, an inner bearing post is disposed on the base, and a bearing is disposed between the inner bearing post and the bearing sleeve.

By using the foregoing technical solution, the bearing is provided between the bearing sleeve and the inner bearing post, thereby avoiding direct contact and friction between the bearing sleeve and the inner bearing post, ensuring the service life of the bearing sleeve or the inner bearing post, and at the same time improving the effect of relative rotation of the bearing sleeve and the inner bearing post.

Furthermore, the first rotational assembly includes: a power source, disposed in the base; a lower rotary support plate, mounted on a rotating shaft of the power source, and capable of rotating synchronously with the rotating shaft; a fixing snap ring, fixedly mounted on the lower rotary support plate; an upper rotary support plate, rotatably mounted in the mounting part, detachably assembled to the lower rotary support plate, and used to drive the second rotational assembly to rotate around the axis of the mounting part; a control panel, disposed in the base, and used to control the power source to be turned on or off; and an oscillating switch, disposed on the control panel.

By using the foregoing technical solution, the oscillating switch is switched on. The control panel is used to control the power source to be turned on to drive the lower rotary support plate assembled to the rotating shaft of the power source to rotate, to further drive the upper rotary support plate to rotate along, thereby implementing the rotation of the main fan unit and the second rotational assembly around the axis of the mounting part, and improving the swing effect. Moreover, the fixing snap ring is disposed to limit the rotation of the second rotational assembly in the upper rotary support plate, thereby avoiding the problem that the second rotational assembly falls off from the upper rotary support plate.

Furthermore, a jack is provided on the lower rotary support plate, and a plug column assembled to the jack is provided on the upper rotary support plate.

By using the foregoing technical solution, the upper rotary support plate and the lower rotary support plate are assembled by using the plug column and the jack. The structure is simple and is easy to implement.

Furthermore, an annular snap slot is provided on an outside wall of the bearing sleeve, a fixing snap ring is disposed between the lower rotary support plate and the bearing sleeve, one end of the fixing snap ring is mounted in the annular snap slot, and the other end of the fixing snap ring abuts the lower rotary support plate.

By using the foregoing technical solution, the annular snap slot and the fixing snap ring are assembled to each other, and the bearing sleeve is limited in the upper rotary support plate, thereby preventing the bearing sleeve from falling off from the upper rotary support plate, and ensuring the normal rotation of the bearing sleeve.

Furthermore, a damping ring is provided on an inside wall, sleeved over the bearing sleeve, of the upper rotary support plate.

By using the foregoing technical solution, the damping ring is disposed, so that the bearing sleeve can be driven by the first rotational assembly to rotate with the first rotational assembly. During manual rotation, the bearing sleeve can stop in any position after rotation, thereby improving the service performance of the oscillating fan.

Furthermore, a first limit boss is disposed on the upper rotary support plate, and a second limit boss is disposed at the bearing sleeve.

By using the foregoing technical solution, the first limit boss and the second limit boss are disposed in combination, and the movement of the bearing sleeve with respect to the upper rotary support plate is limited within a predetermined angle, so as to avoid the problem that internal circuits are twisted and broken due to an excessively large rotation angle of the bearing sleeve.

In conclusion, the present disclosure has the following beneficial effects:

First, the second rotational assembly is disposed to implement rotation of the main fan unit around the horizontal diameter of the main fan unit, to adjust outlet wind directions of the main fan unit, thereby expanding a use range of the oscillating fan.

Second, the first rotational assembly and the second rotational assembly are combined, so that the main fan unit can swing in a vertical direction and can at the same time adjust an outlet wind direction of the main fan unit according to different wind direction requirements, to satisfy requirements of customers and provide the oscillating fan with advantages including a wide swing range, a desirable swing effect, and a wide application range.

Third, the bearing sleeve and the upper rotary support plate are assembled, so that the rotary ring can rotate around the axis of the upper rotary support plate. In this way, rotations are combined to enable the fan to blow wind in all directions in three-dimensional space, thereby ensuring the application range of the fan.

Fourth, the limit assembly is used to limit the rotation of the main fan unit within a predetermined angle, thereby avoiding the problem that internal circuits are twisted and broken due to an excessively large rotation angle of the main fan unit.

Figure 1:
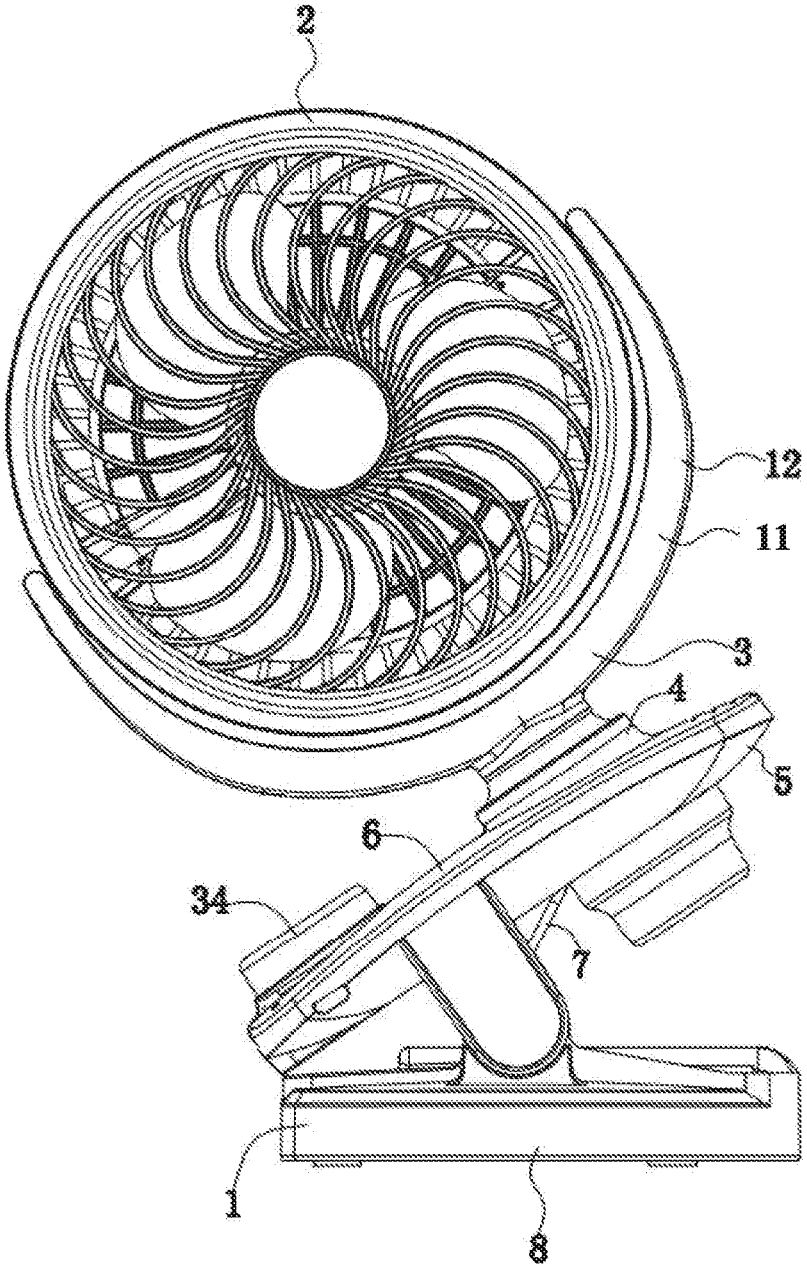
FIG. 1 is an overall schematic structural diagram according to an embodiment of the present disclosure.

Reference numerals: 1, base; 2, main fan unit; 3, oscillating main control assembly; 4, mounting part; 5, bottom clamp shell; 6, top clamp shell; 7, torsion spring; 8, battery holder; 9, battery cover; 10, first rotational assembly; 11, second rotational assembly; 12, rotary ring; 13, bearing sleeve; 14, limit assembly; 15, mounting column; 16, boss; 17, first limit strip; 18, second limit strip; 19, elastic part; 20, inner bearing post; 21, bearing; 22, power source; 23, lower rotary support plate; 24, upper rotary support plate; 25, control panel; 26, oscillating switch; 27, jack; 28, plug column; 29, annular snap slot; 30, fixing snap ring; 31, damping ring; 32, first limit boss; 33, second limit boss; 34, fan switch; and 35, rotating shaft.

DETAILED DESCRIPTION OF EMBODIMENTS

The present disclosure is further described below in detail with reference to the accompanying drawings.

The specific embodiments are merely explanations of the present disclosure but are not intended to limit the present disclosure. A person skilled in the art may read the specification and make modifications according to requirements to the embodiments without creative effort. However, within the claims of the present disclosure, all these modifications are protected by patent laws.

This embodiment relates to an omnidirectional oscillating fan with a clamp. As shown in FIG. 1, the omnidirectional oscillating fan includes a base 1, a main fan unit 2, and an oscillating main control assembly 3.

A mounting part 4 is disposed on a mounting surface of the base 1. The mounting part 4 protrudes in a vertical direction of the mounting surface. The mounting part 4 is used for assembly to the oscillating main control assembly 3. The main fan unit 2 is disposed on a side of a support surface of the base 1. The main fan unit 2 is used to supply air to a user. The oscillating main control assembly 3 is disposed between the main fan unit 2 and the base 1. One end of the oscillating main control assembly 3 is rotatably assembled to the main fan unit 2, and the other end of the oscillating main control assembly 3 is assembled to the base 1. The oscillating main control assembly 3 is used to implement omnidirectional rotation of the main fan unit 2 with respect to the base 1.

Figure 2:
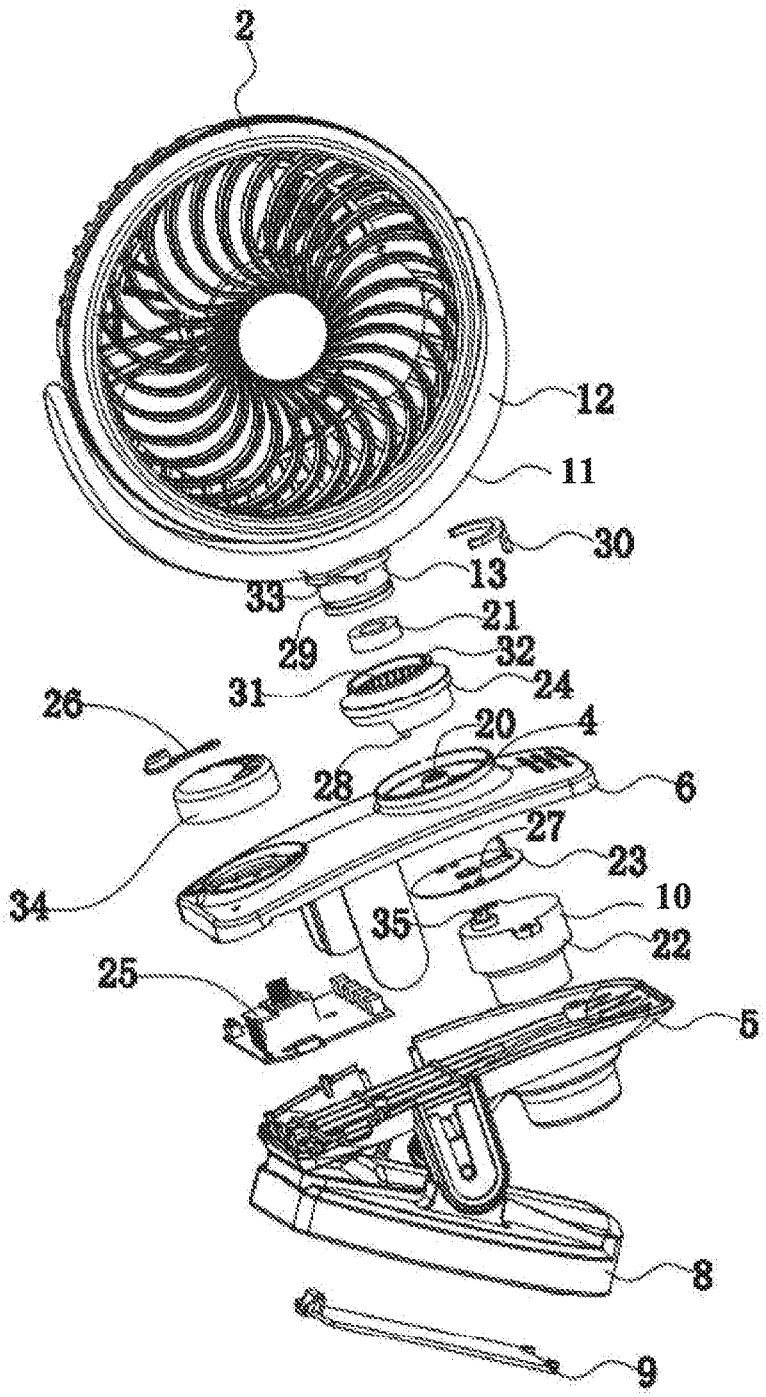
FIG. 2 is an exploded view according to an embodiment of the present disclosure.

As shown in FIG. 1 and FIG. 2, in this embodiment, the base 1 is a clamp base. The clamp base includes a bottom clamp shell 5, a top clamp shell 6, a torsion spring 7, a battery holder 8, and a battery cover 9. The clamp base is used to fixedly hold the oscillating fan on another object. The oscillating main control assembly 3 is partially mounted in the bottom clamp shell 5. The top clamp shell 6 and the bottom clamp shell 5 are assembled, so that a first rotational assembly 10 is fixedly mounted in the bottom clamp shell 5. The top clamp shell 6 is disposed on a fan switch 34. The fan switch 34 is used to control the main fan unit 2 to be turned on or turned off. The battery holder 8 is rotatably assembled to the bottom clamp shell 5 by using a rotating shaft. The torsion spring 7 is sleeved over the rotating shaft. One end of the torsion spring 7 abuts the bottom clamp shell 5. The other end of the torsion spring 7 abuts the battery holder 8. The torsion spring 7 is used to reset the bottom clamp shell 5 and the battery holder 8. The battery holder 8 is disposed on a battery accommodating cavity. The battery cover 9 is disposed on the battery holder 8. The battery cover 9 is used to cover or expose the battery accommodating cavity. A cross section, perpendicular to an extending direction, of the mounting part 4 has a circular shape. The main fan unit 2 has a columnar shape. In another embodiment, the base 1 may further be a disk-shaped base 1. The main fan unit 2 may further have a rectangular cuboid shape.

Figure 3:
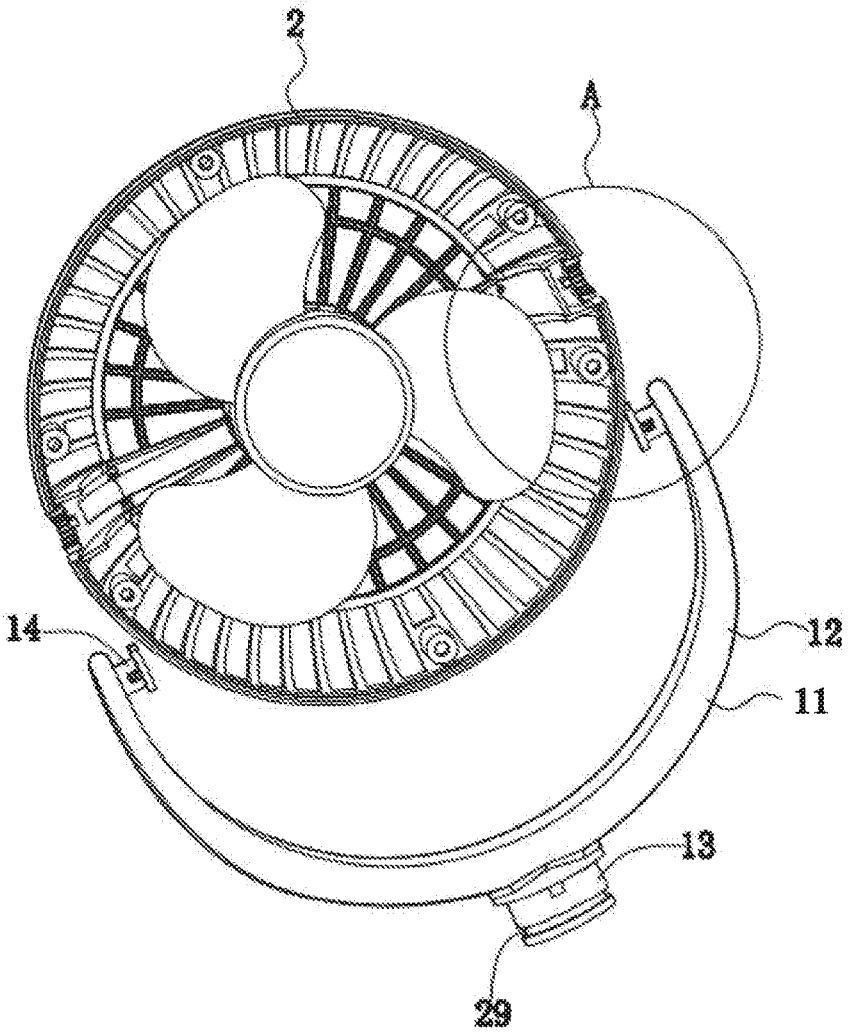
FIG. 3 is a schematic structural diagram of a main fan unit and a second rotational assembly according to an embodiment of the present disclosure.
Figure 4:
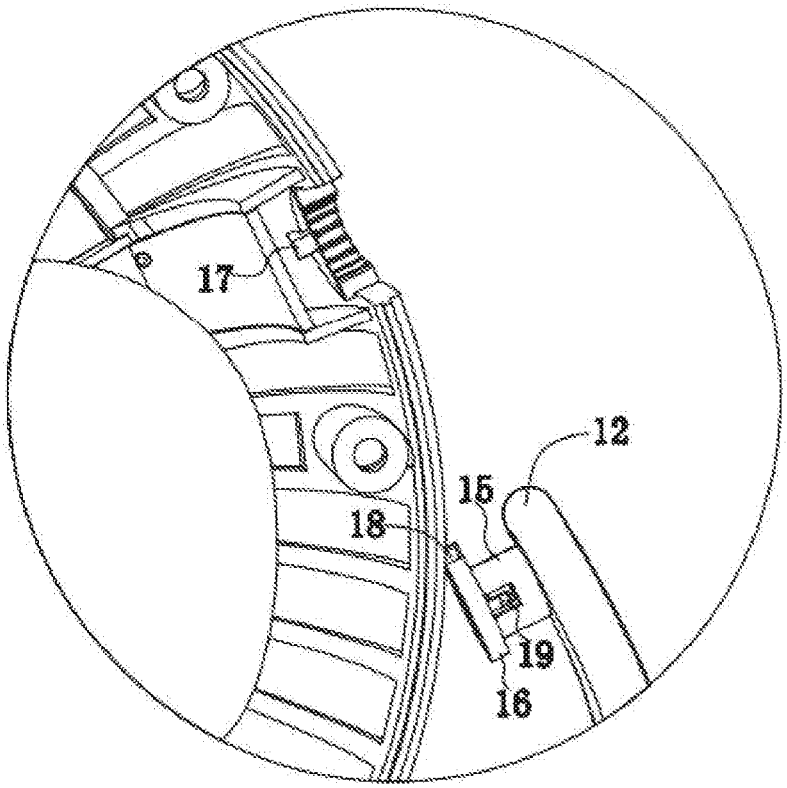
FIG. 4 is an enlarged view of a detail A in FIG. 3.

As shown in FIG. 2, FIG. 3, and FIG. 4, the oscillating main control assembly 3 includes a first rotational assembly 10 and a second rotational assembly 11. The first rotational assembly 10 is partially disposed in the mounting part 4. The first rotational assembly 10 is used to implement rotation of the main fan unit 2 around an axis of the mounting part 4. One end of the second rotational assembly 11 is rotatably assembled to the main fan unit 2. The other end of the second rotational assembly 11 is fixedly assembled to a rotating end of the first rotational assembly 10. The second rotational assembly 11 can rotate synchronously with the first rotational assembly 10. The second rotational assembly 11 is used to implement rotation of the main fan unit 2 around a horizontal diameter of the main fan unit 2.

As shown in FIG. 2, FIG. 3, and FIG. 4, the second rotational assembly 11 includes a rotary ring 12, a bearing sleeve 13, and a limit assembly 14. The rotary ring 12 is rotatably assembled to the main fan unit 2. The bearing sleeve 13 is disposed on a side, near the base 1, of the rotary ring 12 more specifically, at the bottom of the rotary ring 12. The bearing sleeve 13 is rotatably mounted on the first rotational assembly 10. The limit assembly 14 is disposed on the rotary ring 12 and is rotatably assembled to the main fan unit 2. The limit assembly 14 is used to implement rotation of the main fan unit 2 with respect to the rotary ring 12 within a predetermined angle.

In this embodiment, the rotary ring 12 has a semicircular shape. During rotation, to enable the main fan unit 2 to stop in any position after rotation to ensure the effect of using the main fan unit 2, an inner wall of a mounting hole is disposed to have a wavy form, and an elastic part 19 is disposed between a boss 16 and the rotary ring 12 on a mounting column 15. The elastic part 19 is used to abut the inner wall of the mounting hole. The elastic part 19 is an elastic insulating plastic column. To avoid direct contact and friction between the bearing sleeve 13 and an inner bearing post 20, ensure the service life of the bearing sleeve 13 or the inner bearing post 20, and at the same time improve the effect of relative rotation between the bearing sleeve 13 and the inner bearing post 20, the inner bearing post 20 is disposed on the base 1, and a bearing 21 is disposed between the inner bearing post 20 and the bearing sleeve 13.

As shown in FIG. 3 and FIG. 4, the mounting hole is provided in a position, for assembly to the rotary ring 12, on the main fan unit 2. The limit assembly 14 includes a mounting column 15, a first limit strip 17, and a second limit strip 18. The mounting column 15 is disposed protrudingly in a radial direction of the rotary ring 12. The mounting column 15 is used for rotatable assembly to the mounting hole. The boss 16 is provided on a side, away from the rotary ring 12, of the mounting column 15. The first limit strip 17 is disposed protrudingly on a side, away from the rotary ring 12, of the inner wall of the mounting hole. The second limit strip 18 is disposed protrudingly at the boss 16 in a radial direction. The second limit strip 18 is used to adapt to the first limit strip 17. In this embodiment, the first limit strip 17 and the second limit strip 18 both have a rectangular cuboid shape. In another embodiment, the first limit strip 17 and the second limit strip 18 both have an ellipsoidal shape.

As shown in FIG. 1 and FIG. 2, the first rotational assembly 10 includes a power source 22, a lower rotary support plate 23, an upper rotary support plate 24, a control panel 25, and an oscillating switch 26. The power source 22 is disposed in the base 1. The power source 22 is used to provide power for automatic rotation of the first rotational assembly 10. The lower rotary support plate 23 is mounted on a rotating shaft 35 of the power source 22, and can rotate synchronously with the rotating shaft 35. The upper rotary support plate 24 is rotatably mounted in the mounting part 4. The upper rotary support plate 24 is detachably assembled to the lower rotary support plate 23. The upper rotary support plate 24 is used to drive the second rotational assembly 11 to rotate around the axis of the mounting part 4. The control panel 25 is disposed in the base 1. The control panel 25 is used to control the power source 22 to be turned on or off. The oscillating switch 26 is disposed on the control panel 25.

As shown in FIG. 1 and FIG. 2, in this embodiment, to ensure the convenience and stability of mounting the upper rotary support plate 24 and the lower rotary support plate 23, a jack 27 is provided on the lower rotary support plate 23, and a plug column 28 assembled to the jack 27 is provided on the upper rotary support plate 24. The power source 22 is a reversible slow-speed motor. During rotation of the reversible slow-speed motor, if the lower rotary support plate 23 and the upper rotary support plate 24 have friction or become loose, friction may generate powder, and the lower rotary support plate 23 may be damaged. As a result, the lower rotary support plate 23 is made of a metal material to improve the service life of the lower rotary support plate 23. To prevent the bearing sleeve 13 from falling off from the upper rotary support plate 24 and ensure the normal working of the bearing sleeve 13, an annular snap slot 29 is provided on an outside wall of the bearing sleeve 13, and a fixing snap ring 30 is disposed between the lower rotary support plate 23 and the bearing sleeve 13. One end of the fixing snap ring 30 is mounted in the annular snap slot 29, and the other end of the fixing snap ring 30 abuts the lower rotary support plate 23.

To enable the bearing sleeve 13 to be driven by the first rotational assembly 10 to rotate with the first rotational assembly 10 and at the same time ensure that the bearing sleeve 13 can stop in any position after rotation during manual rotation to improve the service performance of the oscillating fan, a damping ring 31 is provided on an inside wall, sleeved over the bearing sleeve 13, of the upper rotary support plate 24. To avoid the problem that internal circuits become twisted and broken due to an excessively large rotation angle of the bearing sleeve 13, a first limit boss 32 is disposed on the upper rotary support plate 24, a second limit boss 33 is disposed at the bearing sleeve 13, and the first limit boss 32 and the second limit boss 33 both have a rectangular cuboid shape.

The design principle in this embodiment is approximately as follows: first, the second rotational assembly 11 is disposed to implement rotation of the main fan unit 2 around the horizontal diameter of the main fan unit 2, to adjust an outlet wind direction of the main fan unit 2, thereby expanding a use range of the oscillating fan; next, the first rotational assembly 10 is disposed to implement rotation of the second rotational assembly 11 around the axis of the mounting part 4, so that the first rotational assembly 10 can swing in a vertical direction, thereby improving the swing effect of the oscillating fan; and finally, the first rotational assembly 10 and the second rotational assembly 11 are combined, so that the main fan unit 2 can swing in a vertical direction and can at the same time adjust an outlet wind direction of the main fan unit 2 according to different wind direction requirements, to satisfy requirements of customers and provide the oscillating fan with advantages including a wide swing range, a desirable swing effect, and a wide application range.

What is claimed is:

1. An omnidirectional oscillating fan with a clamp, comprising:

a base, a mounting part protruding in a vertical direction of a mounting surface of the base being disposed on the mounting surface, a main fan unit, disposed on a side of a support surface of the base, and used to supply air to a user, and an oscillating main control assembly, disposed between the main fan unit and the base, and used to implement omnidirectional rotation of the main fan unit with respect to the base, wherein a cross section, perpendicular to an extending direction, of the mounting part has a circular shape, the main fan unit has a columnar shape, and the oscillating main control assembly comprises:

a first rotational assembly, partially disposed in the mounting part, and used to implement rotation of the main fan unit around an axis of the mounting part, and a second rotational assembly, having one end rotatably assembled to the main fan unit and another end fixedly assembled to a rotating end of the first rotational assembly, and being capable of rotating synchronously with the first rotational assembly, wherein the second rotational assembly is used to implement rotation of the main fan unit) around a horizontal diameter of the main fan unit, wherein the second rotational assembly comprises:

a rotary ring, rotatably assembled to the main fan unit;

a bearing sleeve, disposed on a side, at the bottom of the rotary ring, of the rotary ring, and used for assembly to the first rotational assembly; and a limit assembly, disposed on the rotary ring, rotatably assembled to the main fan unit and used to implement rotation of the main fan unit with respect to the rotary ring within a predetermined angle, and wherein a mounting hole is provided in a position that is on the main fan unit and is for assembly to the rotary ring, and the limit assembly comprises:

a mounting column, disposed protrudingly in a radial direction of the rotary ring, and used for rotatable assembly to the mounting hole, wherein a boss is provided on a side, away from the rotary ring, of the mounting column;

a first limit strip, disposed protrudingly on a side, away from the rotary ring, of an inner wall of the mounting hole; and a second limit strip, disposed protrudingly at the boss in a radial direction, and used to adapt to the first limit strip.

2. The omnidirectional oscillating fan with a clamp according to claim 1, wherein the inner wall of the mounting hole is disposed to have a wavy form, and an elastic part used for abutting the inner wall of the mounting hole is disposed between the boss and the rotary ring on the mounting column.

3. The omnidirectional oscillating fan with a clamp according to claim 2, wherein an inner bearing post is disposed on the base, and a bearing is disposed between the inner bearing post and the bearing sleeve.

4. The omnidirectional oscillating fan with a clamp according to claim 3, wherein the first rotational assembly comprises:

a power source disposed in the base;

a lower rotary support plate, mounted on a rotating shaft of the power source, and being capable of rotating synchronously with the rotating shaft;

an upper rotary support plate, rotatably mounted in the mounting part, detachably assembled to the lower rotary support plate, and used to drive the second rotational assembly to rotate around the axis of the mounting part;

a control panel, disposed in the base, and used to control the power source to be turned on or off; and an oscillating switch, disposed on the control panel.

5. The omnidirectional oscillating fan with a clamp according to claim 4, wherein a jack is provided on the lower rotary support plate, and a plug column assembled to the jack is provided on the upper rotary support plate.

6. The omnidirectional oscillating fan with a clamp according to claim 5, wherein an annular snap slot is provided on an outside wall of the bearing sleeve, a fixing snap ring is disposed between the lower rotary support plate and the bearing sleeve, one end of the fixing snap ring is mounted in the annular snap slot, and the other another end of the fixing snap ring abuts the lower rotary support plate.

7. The omnidirectional oscillating fan with a clamp according to claim 6, wherein a damping ring is provided on an inside wall, sleeved over the bearing sleeve, of the upper rotary support plate.

8. The omnidirectional oscillating fan with a clamp according to claim 7, wherein a first limit boss is disposed on the upper rotary support plate, and a second limit boss is disposed at the bearing sleeve.

* * * * *